US006715583B2

(12) United States Patent
Santos

(10) Patent No.: US 6,715,583 B2
(45) Date of Patent: Apr. 6, 2004

(54) SILENCER AND POWER ENHANCEMENT ENVIRONMENTAL DEVICE

(76) Inventor: Miguel Radhamés Santos, 11 Phillipsport Rd., Wurtsboro, NY (US) 12790

( * ) Notice: Subject to any disclaimer, the term of this patent is extended or adjusted under 35 U.S.C. 154(b) by 0 days.

(21) Appl. No.: 10/462,328

(22) Filed: Jun. 16, 2003

(65) Prior Publication Data

US 2004/0000448 A1 Jan. 1, 2004

Related U.S. Application Data

(60) Provisional application No. 60/392,607, filed on Jul. 1, 2002.

(51) Int. Cl.[7] ..... F01N 1/02

(52) U.S. Cl. ..... 181/251; 181/211

(58) Field of Search ..... 181/251, 211, 181/252, 253, 255, 241, 232

(56) References Cited

U.S. PATENT DOCUMENTS 4,786,299 A * 11/1988 DeMarco ..... 96/382
5,426,269 A * 6/1995 Wagner et al. ..... 181/232
6,612,400 B2 * 9/2003 Bravo ..... 181/254

* cited by examiner

*Primary Examiner*—Kimberly Lockett
(74) *Attorney, Agent, or Firm*—Sandra M. Kotin

(57) ABSTRACT

A device to muffle and purify the exhaust gases from an internal combustion engine. A housing is divided into several chambers with the exhaust gases passing from one chamber to another, each successive chamber diverting the gas flow into an opposing direction. The first chamber is well insulated and contains a series of interconnected axial and equatorial tubes which provide multiple passageways with a large surface area which encourages repeated collisions of the gas molecules with the walls of the passages and with other molecules. While in this chamber the kinetic energy is greatly increased as is the temperature of the exhaust gases causing a break down of polluting molecules. Thereafter, the gases are directed alternately forward and rearward through several open chambers of increasing size which enable expansion and cooling of the gases and reduction of the associated noise. Finally the purified and cooled gases exit the last chamber into the atmosphere and pose no threat to the environment.

9 Claims, 9 Drawing Sheets

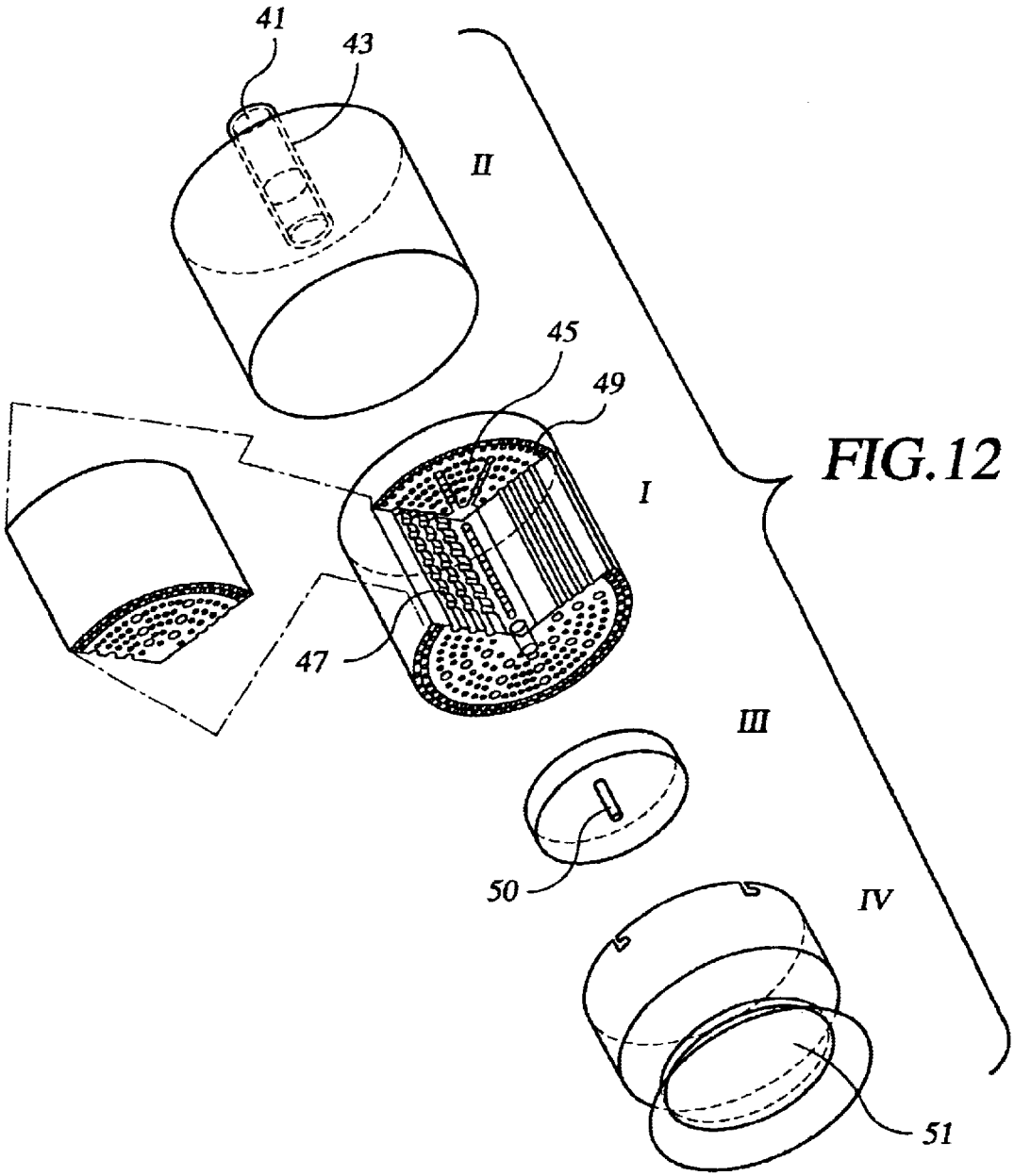
FIG.12
FIG.14
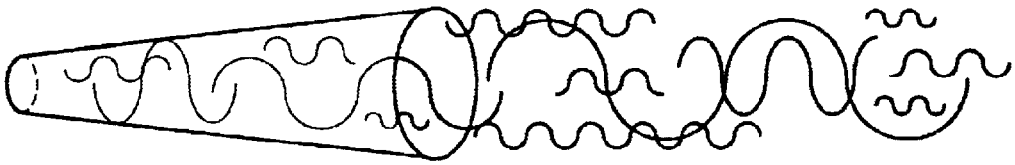

SILENCER AND POWER ENHANCEMENT ENVIRONMENTAL DEVICE

This application claims the benefit of Provisional application Ser. No. 60/392,607 filed Jul. 1, 2002.

FIELD OF THE INVENTION

The instant invention relates to a device that reduces harmful emissions from the exhaust of internal combustion engines and enhances engine power while functioning as a muffler to greatly decrease the noise associated with such engines.

BACKGROUND OF THE INVENTION

Since the invention of the internal combustion engine there has been the need to muffle the noise generated by such engines and to decrease the harmful emissions that they inevitably produce. Many devices have been developed to solve these problems, but most of the devices address one problem or the other. Those claiming to solve both problems often fall short or require considerable space making their use in motor vehicles impractical.

Many mufflers rely on changing the flow direction of the exhaust gases which results in a change in the fluid dynamics with a concomitant reduction in noise. Gramm, in U.S. Pat. No. 823,115 discloses a muffler that consists of two sections, the first being the larger. The exhaust gases enter the first section then pass into the second section from which the gases are discharged. Both sections are made up of a series of concentric cylinders having perforations in their walls. The perforations are located at different levels in adjacent cylinders. The gases move in altering directions as they pass from one cylinder to another in the first section then through similar paths of changing flow directions in the second section. The gases can expand freely in the larger first section, and then the volume is decreased in the second section before the gases are discharged. The gases are permitted to move freely through the system with no formation of back pressure. Construction materials include cast iron and sheet metal making for a clumsy and heavy unit. A lightweight muffler is described by Flugger in U.S. Pat. No. 4,220,219. The gases enter through an inlet tube having a wide exit end with a cup barrier that causes the flowing gases to change direction and thereafter pass through a narrow outlet from which the gases again strike a wall and reverse direction. Finally the gases exit through a perforated outlet pipe. See also U.S. Pat. Nos. 5,952,625 and 6,199,658 both to Huff. None of these patents effect pollutants that leave the systems as part of the exhaust gases.

A muffler also relying on repeated changes in direction of the gas flow and utilizing a closed system of pipes with circulating water within the main chamber to remove heat from the exhaust gases is taught by Khosropour et al. in U.S. Pat. No. 4,450,932. The added circulating water cooling system would not be practical for use in motor vehicles.

Kasper designed a muffler to reduce back pressure and increase engine efficiency that is taught in U.S. Pat. No. 4,222,456. A housing contains a large tube with a widening conical exit end. The tube is surrounded by material that conducts heat from the tube to the housing and also deadens sound. Within the large tube is another inner tube with a converging midsection and narrow exit port through which the gases pass before entering the diverging exit end of the large tube. Vanes are situated around the narrow exit port of the inner tube. Some of the gases bypass the inner tube and flow in a straight pattern while the gases passing through the inner tube and vanes are caused to move in a vortex around the first stream and reduce back pressure. Basically the gases travel in a straight line through this system. The insulation accounts for most of the noise suppression.

Childs describes an apparatus used to remove smoke and extract heat from the exhaust gases from a diesel engine. The exhaust gases pass into an insulated pipe that has a Venturi section and fresh air source. The gas and air mixture then moves over a heating element after which the flow path changes directions several times before the discharge at the top of the system. This device is designed to be mounted vertically and is not practical for use in automobiles and other motor vehicles. (U.S. Pat. No. 5,245,933) A device used to burn automobile exhaust gases utilizes a cylindrical outer shell and an inner shell with insulation between them. The gases enter a ceramic spiral cone to concentrate the exhaust flow which then passes through a series of slotted ceramic discs and finally into a cooling pipe. The discs become very hot and the increased surface area of the several discs assist in burning any pollutants. A second embodiment has an air intake and spark plug to insure more complete combustion of the exhaust gases. (Gordon in U.S. Pat. No. 4,183,896) The burning of gases near the exit port may present a problem if used with motor vehicles, and this device would have to be used in addition to a muffler.

Devices have been developed that muffle engine noise and also oxidize the exhaust gases. One of those is described by Barkelew in U.S. Pat. No. 2,831,548 which comprises several concentric tubes, some made of conducting material and others holding insulation. There is an air intake to insure better combustion of exhaust gases and a heating element near the exit port. A flame can also be used for combustion of the gases. The change in direction of flow through the various tubes provides the muffling effect. Miller et al. in U.S. Pat. No. 2,938,593 discloses a muffler that is oval in cross section with an inlet pipe and outlet pipe. The interior has a main section separated by four baffles into three chambers and there are two side sections, each separated into two chambers. The gases pass from one chamber to the other by means of stub pipes and finally enter an outlet chamber. The different paths taken create different dynamics causing the sound to be muffled and eliminating back pressure. A second embodiment includes a n electric current to ionize the gases and decrease pollutant content. Gerlach, in U.S. Pat. No. 2,986,000 teaches a muffler and burner that is square in cross section and is divided into three chambers. The main central chamber is surrounded by a wire coil and has a Meeker burner screen at the top. There are two perforated side tubes and two narrow air intake tubes that discharge air into the central chamber. All gases mix in an upper chamber where combustion can take place before the gases enter the discharge pipe. Changing the flow directions changes the dynamics to muffle the sound and combustion removes pollutants from the discharge. Initiation of combustion in the muffler, especially near the exit port, would expel very hot gases into the atmosphere which would be detrimental to the environment.

Another device designed to be used to silence and purify exhaust gases from a n internal combustion engine is taught by Frederiksen et al. in U.S. Pat. No. 6,312,650. This device consists of an airtight casing with an exhaust inlet pipe and an exhaust outlet pipe and has at least two acoustic compartments within. The first compartment contains one or more "monolithic bodies" with multiple channels or porosities. One type of monolith is made from corrugated foil that is wound u p cylindrically while the other type is made of a ceramic material with many vertical and horizontal channels. The internal surfaces of the monolith may be covered by catalytic layers to promote purification of gases. Specific solid catalytic particles or a spray of active solutions may be introduced to break down the gases. The second compartment is packed with absorbent material such as glass wool. The fluid dynamics undergoes several changes to diminish sound. This system is suited to diesel engines. Since thin layers of catalytic material are applied, they would have to be reapplied periodically to maintain proper emission control None of the prior art devices cause combustion of the exhaust gases without the necessity of a means to ignite the gases and an entry for the introduction of air to the combustion chamber. None of the prior art devices rely on frictional effects and molecular collisions to generate the heat needed to break down pollutants.

None of the prior art devices are capable of both muffling the sound an d purifying the exhaust gases while at the same time being compact, efficient, not requiring combustion assistance or catalysts and causing no back pressure so as to increase engine efficiency.

BRIEF SUMMARY OF THE INVENTION

The present invention provides a single unit that accomplishes the muffling of noise associated with internal combustion engines and also serves to purify the exhaust gases to eliminate or greatly diminish the quantity of pollutants in the exiting gases. The present invention is compact and its design not only insures that there is no back pressure, but it actually increases engine efficiency.

It is an object of the present invention to provide a muffler and gas purifier in one compact unit.

It is a further object of the present invention to provide a muffler and gas purifier that is smaller and more compact than the conventional muffler alone.

It is another object of the present invention to provide a muffler-gas purifier combination that does not create back pressure or back flow and therefore does not diminish engine output.

It is a further object of the present invention to actually increase the efficiency of the engine.

A still further object of the present invention is to provide sufficient expansion of exhaust gases after the heating process so that the gases are thereafter cooled before being released into the atmosphere.

Another object of the present invention is to have no noxious gases exit the unit.

An object of the present invention is to provide a muffler and gas purifier that does not accumulate any particle build-up within its chambers so that it does not have to be serviced or replaced.

A further object of the present invention is to have sufficient internal insulation so that no excess heat reaches the outer surfaces of the device and the environment.

Another object of the present invention is to provide a thermo-generator such that the heat needed to break down noxious gases is generated within the core of the device without the need for a catalyst or beating element.

A still further object of the present invention is to provide a rapid temperature increase and a subsequent cool down.

It is another object of the present invention to have the device constructed of material that can withstand repeated heating without exhibiting wear or corrosion.

Another object of the present invention is to have a device that is cost effective to manufacture and to use.

The present invention is an anti-pollution and muffling device for the treatment of the exhaust gases produced by internal combustion engines and the like. The device comprises entry means to bring the exhaust gases from the internal combustion engine to the device and an insulated core for receiving the exhaust gases. There are multiple interconnected passage means within the core for directing the gas flow in diverse paths, greatly increasing the surface area within the core, and increasing the opportunities for collisions of gas molecules with the walls of the passage means and with each other. The increase in collisions result in a progressive and substantial rise in the kinetic energy and thereby the temperature within the core causing alterations to the molecules which greatly diminishes pollutants contained therein and the diverse paths result in repeated alteration of the direction of the gas flow causing a muffling effect in the noise associated with such gas flow. There are tube means to convey the gas flow containing the altered molecules out of the core, at lease two chamber means, disposed at opposing ends of the core, and being integral therewith, the first of the at least two chamber means for receiving the gas flow from the core and the second of the at least two chamber means for receiving the gas flow from the first of the at least two chamber means. The chamber means are for permitting the gas flow to expand and experience fewer collisions and form into swirling and convection patterns resulting in a successive decrease in the kinetic energy and the temperature as the gas flow moves from the first to the second of the at least two chamber means and such that the gas flow is caused to reverse direction as it progresses from the first to the second of the at least two chamber means resulting in a further muffling effect in the noise associated with the exhaust gas flow. There are also transport means to direct the gas flow from the core into the first of the at least two chamber means, transport means to direct the gas flow from the first of the at least two chamber means into the second of the at least two chamber means, and conduit means for removing the cooled noiseless exhaust gases containing the altered molecules from the device.

An anti-pollution and muffling device for the treatment of the exhaust gases produced by internal combustion engines and the like, said device comprises an elongated housing having a forward end and a rearward end, a gas inlet pipe situated at the forward end of the housing to receive the exhaust gases, a first chamber substantially centrally situated within the housing and forming the core of the device. The first chamber is substantially cylindrical and comprises an insulated outer wall, a bottom plate, an axial gas inlet tube in communication with the gas inlet pipe and extending to and being integral with the bottom plate, a plurality of axial tubes in laterally spaced parallel relation to each other and to said gas inlet tube, said axial tubes being open at their forward ends and being integral with the bottom plate at their rearward ends, a plurality of openings symmetrically disposed about and along the length of the gas inlet tube, a plurality of equatorial tubes having inner ends and outer ends. The equatorial tubes are in communication with the openings in the gas inlet tube at their inner ends and integral with the outer wall at their outer ends and further being in communication with the axial tubes with which they intersect, said axial tubes and equatorial tubes forming a complex network of interconnected passageways within the first chamber into which the exhaust gases are directed, and insulation means disposed around the first chamber and between the inlet tube, the axial tubes and the equatorial tubes for maintaining heat generated within the first chamber. There is a second chamber disposed forward of the first chamber and being in communication with the forward ends of the axial tubes through which the gases leave the first chamber and enter the second chamber, a first series of lateral passages extending rearwardly from the second chamber through which the gases exit the second chamber, a third chamber disposed rearward of the first chamber and in communication with the first series of lateral passages, at least one additional chamber, at least one second series of lateral passages extending from the third chamber to the at least one additional chamber for the passage of the gases therethrough, and a gas outlet pipe in communication with the at least one additional chamber from which the gases exit the device. The exhaust gases enter the device and pass into the first chamber where they undergo multiple collisions with the walls of the axial an d equatorial tubes and each other such that the kinetic energy and thereby the temperature is progressively and substantially increased causing alterations to the gas molecules which alterations diminish the pollutants contained therein and repeatedly reversing direction through the interconnected passageways thereby attenuating the noise associated with the exhaust gases, and thereafter the exhaust gases proceed from the first chamber to the next, each time reversing direction and thereby interfering with the sound wave progression and altering the sound wave patterns to further attenuate the noise, and such that the gas molecules spread out into the successive chambers where they are formed into swirling and convection patterns with a decrease in the number of collisions thereby decreasing the kinetic energy and the temperature such that when the exhaust gases exit the device into the atmosphere there are no harmful molecules and the exhaust gases are cooled sufficiently so as not to present a problem to the environment.

A method for muffling the noise associated with exhaust gases from internal combustion engines and the like and for purifying the exhaust gases, comprises the steps of obtaining an insulated chamber containing multiple interconnected passages facing in diverse directions; directing the exhaust gases into said chamber; causing the molecules of the exhaust gases to repeatedly collide with the walls of the passages, the ends of the passages, and with other molecules; accelerating the exhaust gases; substantially increasing the kinetic energy of the molecules and thereby the temperature of the exhaust gases causing an alteration of the molecules; causing the exhaust gases to repeatedly change their direction of flow; and diminishing the noise associated with the exhaust gases. A second chamber is provided, adjacent to said first chamber and open within. The exhaust gases with the altered gas molecules are directed into the second chamber; thereafter decelerating the exhaust gases; decreasing the kinetic energy of the molecules and thereby cooling the exhaust gases; and further diminishing the noise. A third chamber is provided, open within, adjacent to the first chamber, and being disposed in an opposing direction from the second chamber. The exhaust gases are directed into the third chamber, further decelerating the exhaust gases; expanding the exhaust gases; cooling the exhaust gases; and further diminishing the noise associated with the exhaust gases. Finally providing at least one additional chamber, open within and disposed in a n opposing direction from the third chamber; decelerating the exhaust gases; expanding the exhaust gases; cooling the exhaust gas stream; further diminishing the noise; and directing the cooled, altered and noiseless exhaust gases into the atmosphere. The repeated change in direction of the exhaust gases causes interference in the sound wave patterns and muffles the noise while the substantial increase in temperature in the first chamber alters the molecules to purify the exhaust gases and the subsequent expansion of the exhaust gases, the decrease in the number of collisions and the change in flow patterns as they pass through the second, third and at least one additional chamber results in a cooling of the exhaust gases before they enter the atmosphere.

Other features and advantages of the invention will be seen from the following description and drawings.

BRIEF DESCRIPTION OF THE DRAWINGS

FIG. 12 is an exploded view of the second embodiment;

FIG. 14 is a schematic view of an alternative equatorial tube showing sound wave interference patterns.

DETAILED DESCRIPTION OF THE INVENTION

Figure 1:
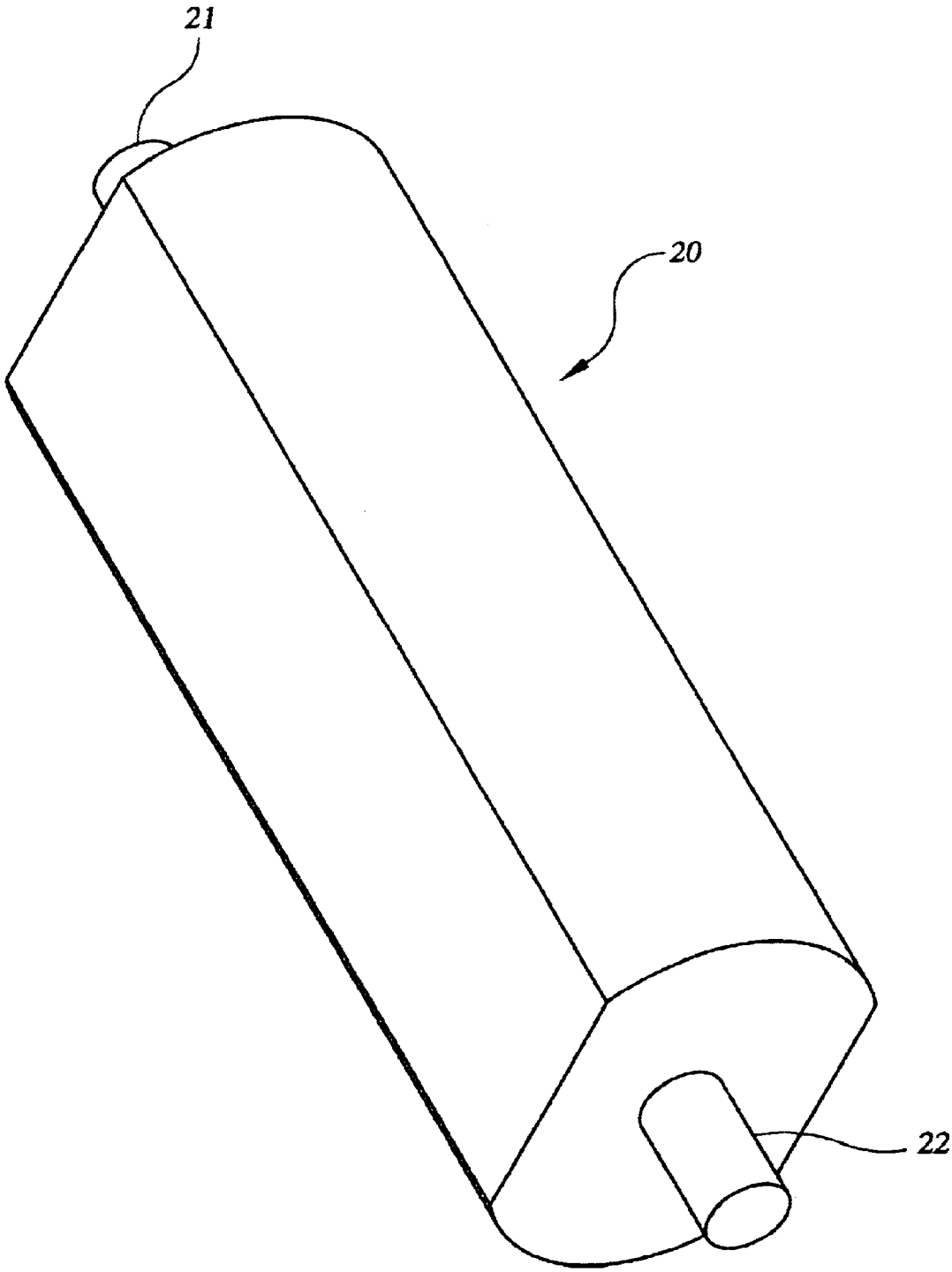
FIG. 1 is a perspective view of the device of the present invention.

The silencer and power enhancement environmental device 20 (S.P.E.E.D.) of the present invention may be designed to replace both the conventional muffler and the catalytic converter now installed in most motor vehicles. The device 20 may be in the form of a cylinder with flattened sides as seen in FIG. 1, though it may be of other shapes. There may be a gas inlet pipe 21 situated at the forward end 34 by which the device 20 is attached to the exhaust pipe (not shown) of the motor vehicle, and a gas outlet pipe 22 at the rearward end 35 through which the gases exit the device 20.

Figure 3:
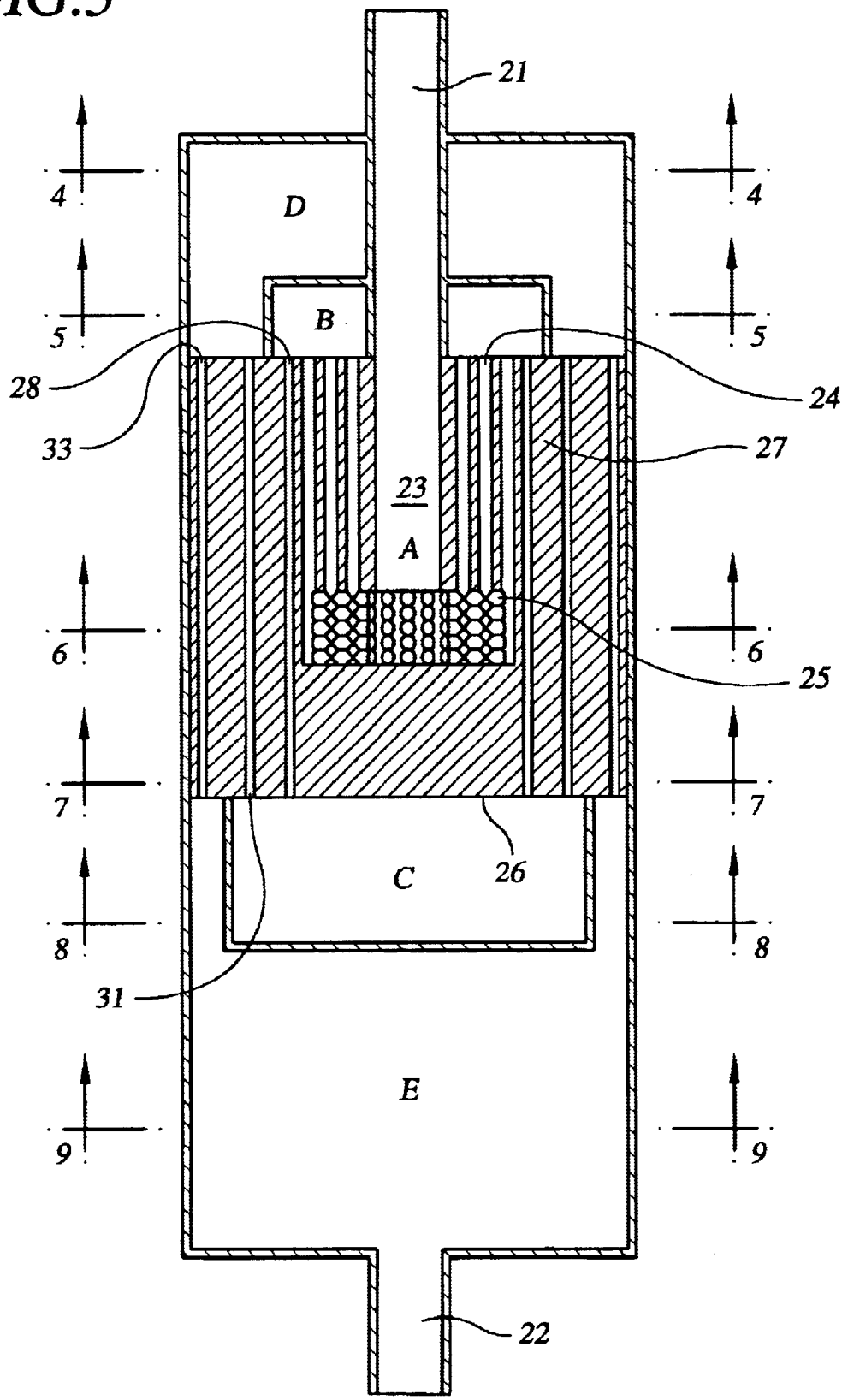
FIG. 3 is a section through line 3—3 of FIG. 2.
Figure 10:
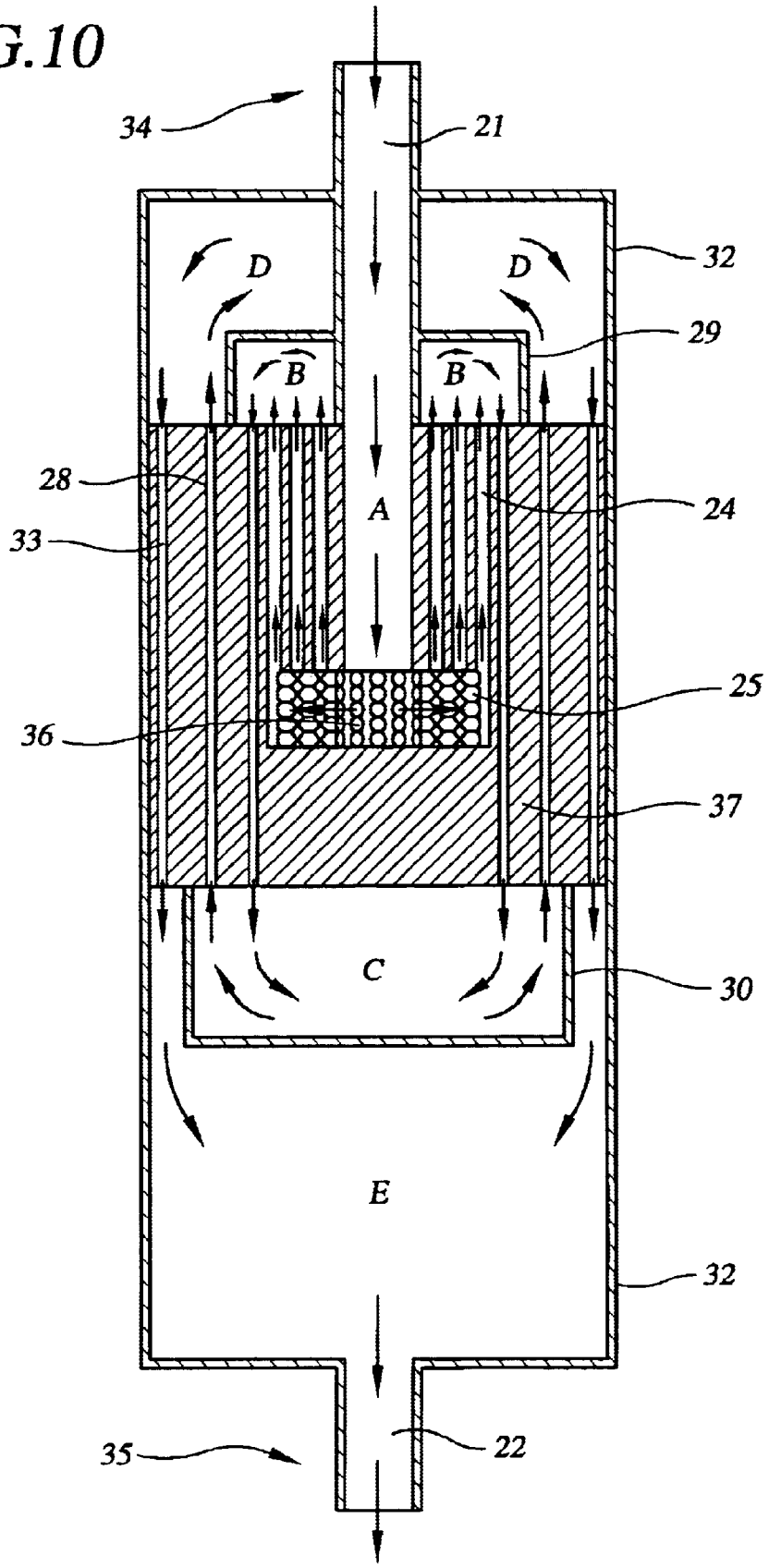
FIG. 10 is a section through line 3—3 of FIG. 2 showing the flow pattern of the gases.

The interior of the device 20 may be divided into five chambers through which the gases must flow before exiting. These five chambers are designated by the letters A through E in FIGS. 3 and 10.

Figure 2:
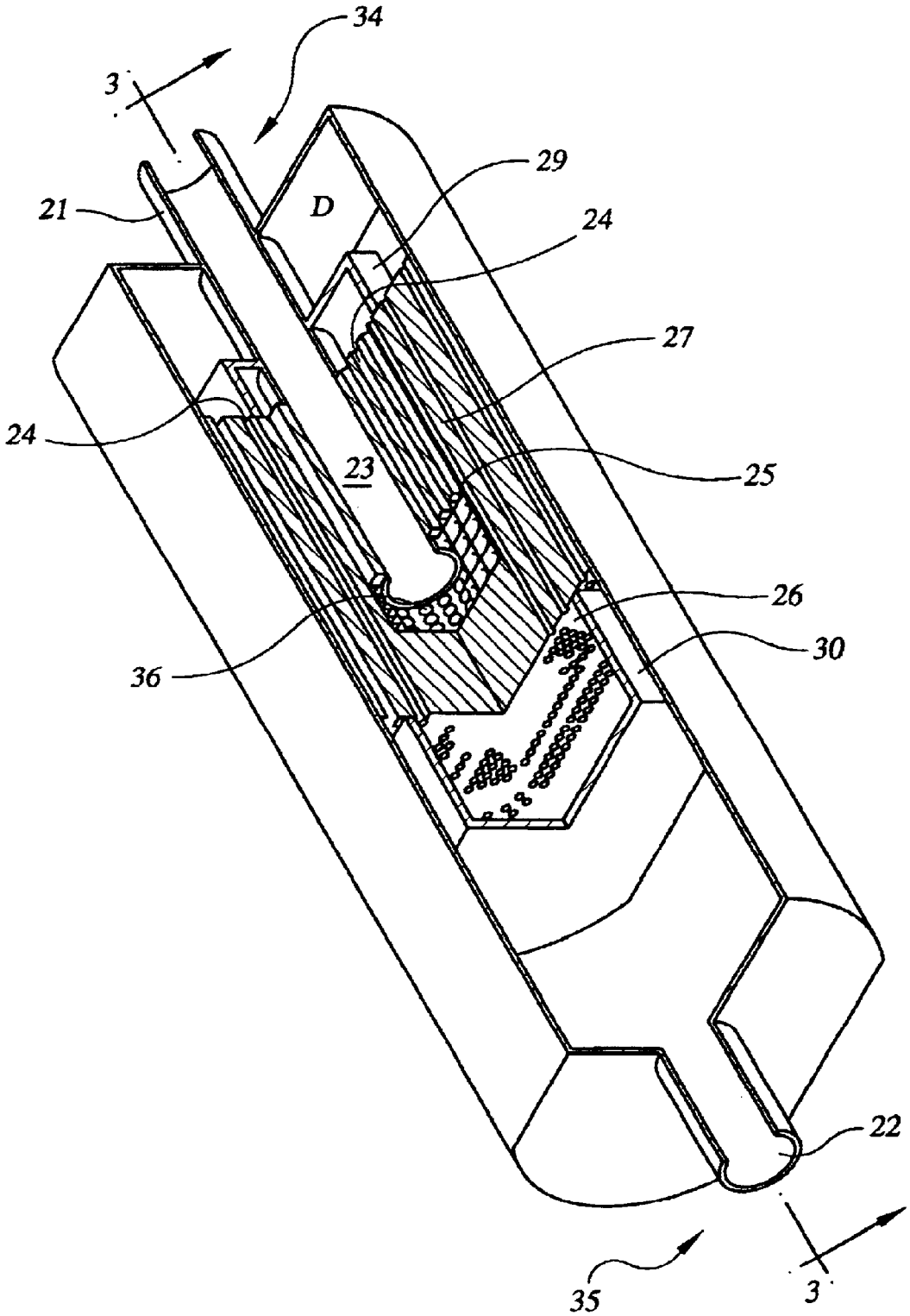
FIG. 2 is a perspective partial cutaway view of the present invention.
Figure 6:
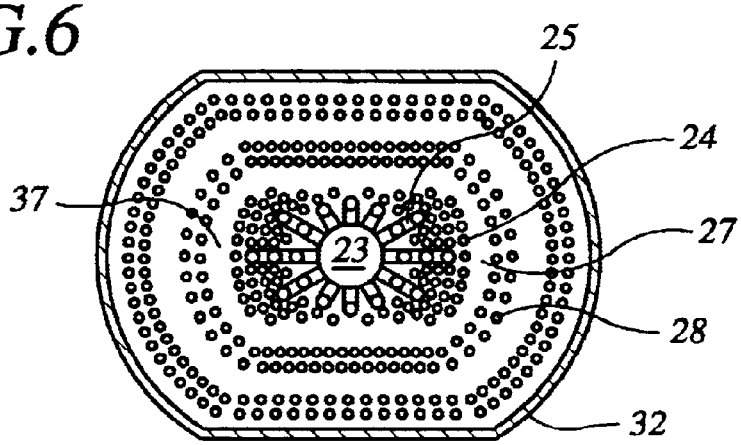
FIG. 6 is section through line 6—6 of FIG. 3.
Figure 7:
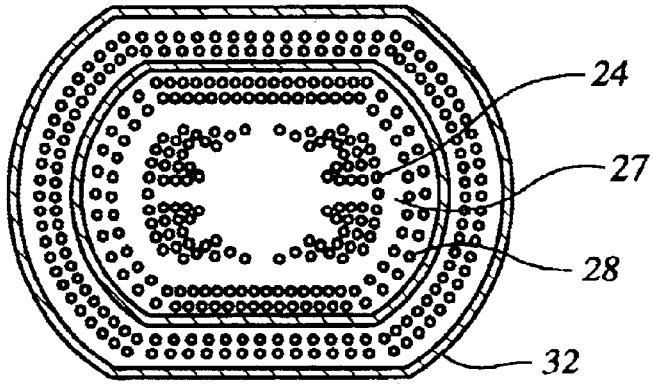
FIG. 7 is section through line 7—7 of FIG. 3.

The vehicle exhaust gases may enter inlet pipe 21 through which the gases may travel into the first chamber, the core of the device 20, chamber A. Chamber A may be the most complex of the five chambers and may be constructed of a central axial tube 23 contiguous with the inlet pipe 21 and a series of narrower axial tubes 24 symmetrically arranged around the central tube 23. There may be a plurality of openings 36 spaced symmetrically about and along the length of the central tube 23 that may communicate with equatorial tubes 25 extending outwardly from the central tube 23. The equatorial tubes 25 may further intersect with the axial tubes 24 to create a complex system of interconnected passageways within chamber A. (FIGS. 2 and 6) All of the axial tubes 24 may be open at their forward ends through which the gases may exit chamber A and may be closed at their rearward ends by a bottom plate 26 which may form the rearward wall of chamber A as well as the forward walls of chambers C and E (FIG. 7).

The sum of the cross sectional areas of the openings 36 in the central tube 23 may be equal to or greater than the cross sectional area of the inlet pipe 21 and the central tube 23 to prevent back pressure or back flow to the engine. The gases may enter the equatorial tubes 25 from the central tube 23 and may exit the equatorial tubes 25 through any of the intersections with the axial tubes 24. The outer ends of the equatorial tubes 25 may be contiguous with the outer wall 27 of chamber A which may serve to close off the ends of these tubes. The exhaust gases may flow into and out of the many passageways formed by the interconnected axial tubes 24 and equatorial tubes 25 and may finally leave chamber A through the forward open ends of the axial tubes 24. The areas in chamber A between the tubes may contain insulation 37 to maintain the heat within the core and to favor the progressive buildup of heat so that the temperatures within chamber A may become quite high.

The plurality of interconnected axial and equatorial tubes in chamber A may provide a series of passageways which collectively may furnish the largest surface area of any of the five chambers within the device 20. The exhaust gases from the engine may be at elevated temperatures when they enter chamber A and the gas molecules may undergo repeated collisions with the walls of the interconnected passageways and with each other. These molecules may also be repeatedly bombarded by the continuous stream of incoming exhaust gases from the engine. The outer walls 27 of chamber A and the spaces between the axial and equatorial tubes may contain insulation 37 so that the heat of the entering gases and the heat caused by the repeated collisions may not be dissipated, and in actuality may be further increased.

The back-flow of gas molecules from collisions with the ends of the axial and equatorial tubes may also contribute to an increase in kinetic energy and the h eat build-up with chamber A where core temperatures may rise considerably. Another contributing factor to the internal heat build-up in chamber A may be the friction effect of the gas molecules moving against the very large surface area provided by the interior walls of the interconnected passageways. This friction effect may retard the flow of the moving gas molecules. The more friction, the more heat generated and the greater may be the effect on the flow rate. This effect may also contribute to the muffling attributes of the device 20. These several factors contributing to the rise in temperature within the core may cause an exponential heat generation process.

As the temperature rises the molecules may be caused to move even faster overcoming the friction effect and also increasing the number of collisions, the kinetic energy and the temperature. This significant temperature increase within the core, chamber A, may cause the molecules to break apart such that the undesirable exhaust gases may be broken apart and chemically altered into non polluting molecules. As the larger molecules are broken down into smaller ones, there may be less friction and an increase in the flow rate. This process may be accomplished entirely without the need for any catalytic enhancement. As noted above the walls of chamber A may be insulated to maintain the highest temperatures within that chamber favoring maximum molecular breakdown. The altered gases may finally exit from chamber A through the open ends of the axial tubes 24 into chamber B situated adjacent to and forward of chamber A.

Figure 5:
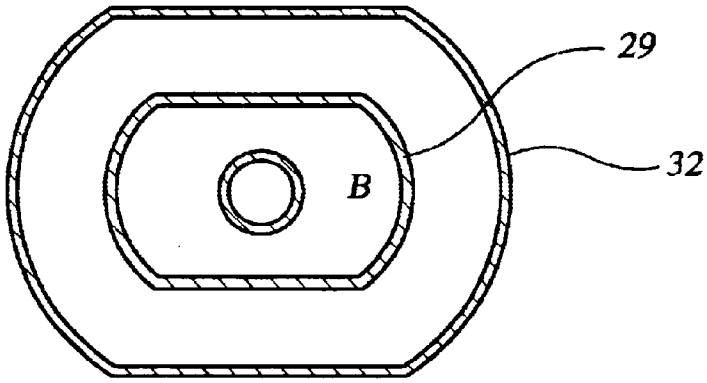
FIG. 5 is a section through line 5—5 of FIG. 3.

The interior of chamber B may be essentially open space (FIG. 5) where the molecules may swirl around and collide with the walls and each other before they exit through axial tubes 28 which may divert the flow of gases rearward. Chamber B may be considerably smaller in size than chamber A and since the interior may be open space there may be considerably less surface area for collisions and frictional interactions to occur. The very large surface area and volume of the many interconnected passageways of chamber A may have encouraged multiple collisions and the high kinetic energy throughout chamber A so that the kinetic energy of the molecules and the temperature may remain quite high within chamber B. The main function of chamber B may be to reverse the direction of the gas flow, confine the motion of the gas flow to few swirling convection patterns, and begin a decrease in kinetic energy. Additionally, central tube 23 may extend through the center of chamber B before entering chamber A. Since the temperatures in chamber B may be quite high, the gases in central tube 23 may be heated as they pass through this portion of the central tube 23 providing an initial boost in kinetic energy even before the gases enter the interconnected passageways of chamber A.

Figure 8:
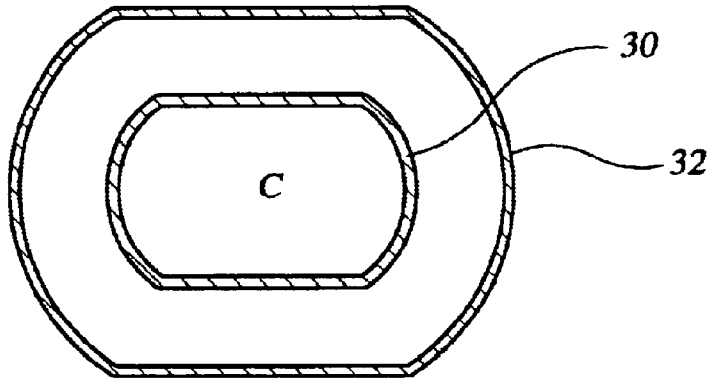
FIG. 8 is section through line 8—8 of FIG. 3.

The gas flow may exit chamber B through rearward directing axial tubes 28 which may direct the gas flow into chamber C which may be situated adjacent to and rearward of chamber A. See FIGS. 2, 3 and 10. Chamber C may be larger than chamber B with an open interior (FIG. 8). The larger volume may permit the molecules to expand outwardly and swirl around in more complex patterns with fewer collisions, both with other molecules and with the walls of chamber C. The kinetic energy of the molecules may decrease resulting in a cooling effect on the gas mixture. The walls of chamber B and chamber C may not be insulated. In the larger chamber C, this may contribute to dissipating the heat, decreasing the kinetic energy, and slowing the molecules, all contributing to the cooling effect within chamber C.

Figure 4:
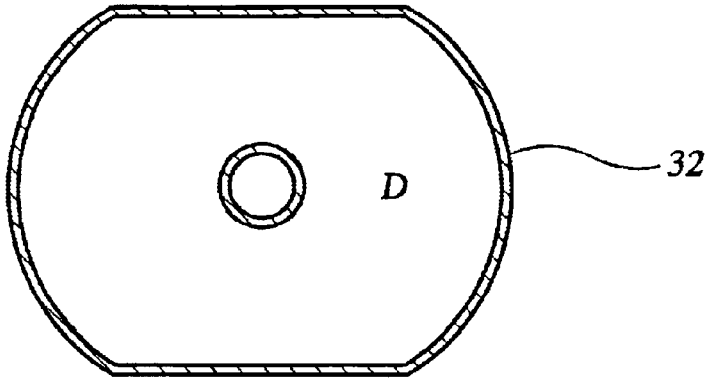
FIG. 4 is a section through line 4—4 of FIG. 3.
Figure 9:
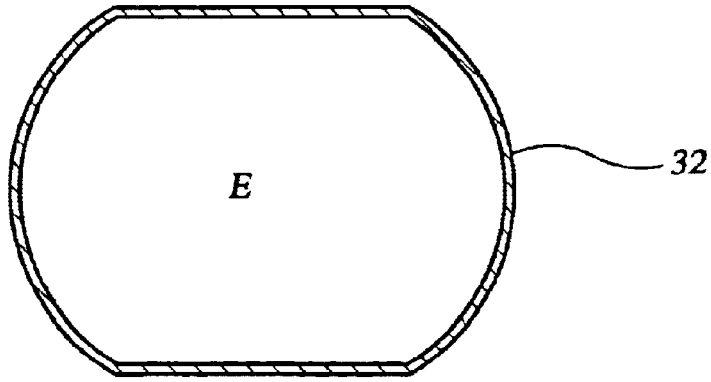
FIG. 9 is section through line 9—9 of FIG. 3.

The gas flow from chamber C may be forwardly directed through axial tubes 31 into chamber D (FIG. 4) situated at the forward end of the device 20. This chamber may be larger than chamber C and the outer walls 32 of chamber D may have no insulation and may also be part of the outermost wall or housing of the device 20. The increased surface area and volume found in chamber D may allow further expansion and significant cooling of the gases while encouraging more swirling movement and convection currents within the chamber. The flow may proceed rearwardly through axial tubes 33 into the last chamber at the rear end 35 of the device 20, chamber E. Chamber E may be the largest chamber (FIGS. 3, 9 and 10) and may permit even further expansion of the gas mixture, a decrease in kinetic energy, and cooling of the gases which may then exit the device 20 through the outlet pipe 22. The outer walls 32 of chamber E may also be part of the housing of the device 20. By the time the gases reach the outlet pipe 22 they have been cooled considerably and molecularly altered so they may be expelled into the atmosphere without creating a threat to the environment.

In its course through the device 20 the gas flow may be repeatedly diverted first rearwardly then forwardly. The changes in direction as well as the differences in the distances traveled from one chamber to another may create interferences in the sound wave patterns which may result in the muffling of the noise associated with the exhaust flow from the internal combustion engine. The specific multi-chambered design of the interior of the device 20 of the instant invention may be to provide maximum flow pattern reversal for the size of the device 20 so as to muffle the noise, and to allow for the temperature build-up in the core which may contribute to the breakdown of pollutants. Finally, the progress of the gas through the subsequent chambers may provide the cooling effect so that the gases released may not have a detrimental effect on the environment.

The device 20 of the instant invention may integrate several principles to accomplish the goals of providing a good muffler, increasing engine efficiency and greatly decreasing or eliminating pollutants in the final exhaust stream.

The many openings 36 from the central tube 23 into the equatorial tubes 25 may contribute to the degree of noise abatement achieved by creating interference patterns within the sound wave progression. There may be further interference as the gas flow enters the equatorial tubes 25. If the frequency and amplitude of the sound waves in such a system is known, the length and diameter of the equatorial tubes 25 may be expressly constructed to cause the greatest interference in the sound wave patterns to further enhance the noise abatement characteristics of the device 20.

The number of passageways within the core may also provide more paths for the rapidly moving molecules resulting in a reduction in the stress of the exhaust flow which may also reduce the flow pressure and the noise. The flow pressure may be reduced sufficiently to actually pull the exhaust flow into the device from the engine exhaust pipe. This stress reduction may increase the efficiency output of the engine as a bonus effect in addition to reducing noise and pollution emissions.

In essence, this device may be designed to divert the flow of gases into a complex arrangement of passages and to reverse directions of the flow so as to cause maximum interference in the sound wave patterns to diminish the noise associated with the exhaust flow of the internal combustion engine. The complex pattern of passages and the reversing of direction of the gas flow may insure a good muffling effect. The degree of muffling may be further enhanced b y making some or all of the equatorial tubes in the core frusto-conical in shape so that the passages diverge from the inner ends of the equatorial tubes to their outer ends. This divergence may create additional sound wave interference patterns as shown in FIG. 14.

The temperature gradients within the various chambers of the device of the instant invention may follow the well known bell shaped curve. There may be a rapid rise in temperature and a slower cool down (the trailing end of the curve) before the gases exit the system and are discharged into the atmosphere.

Figure 11:
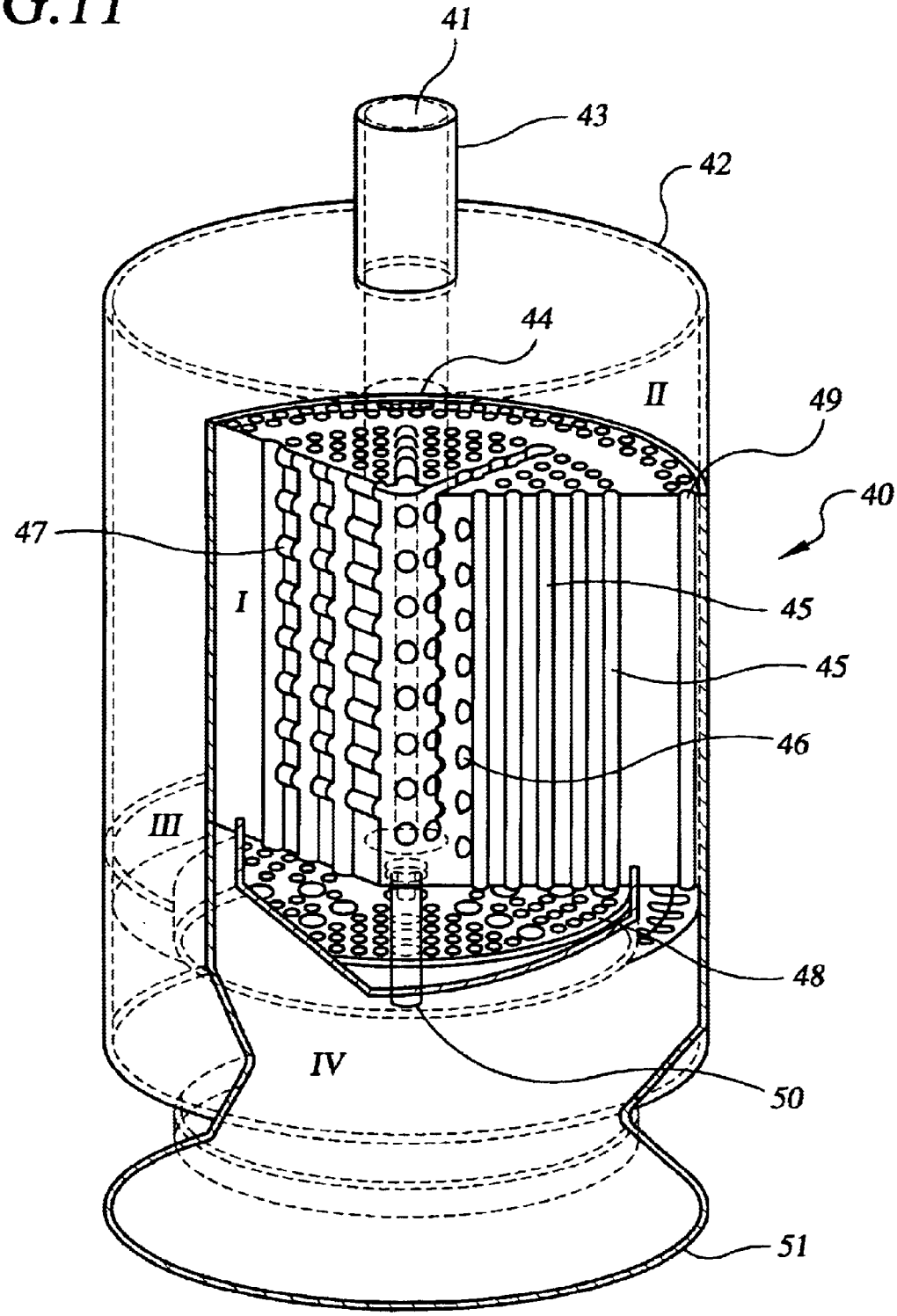
FIG. 11 is a perspective view of a second embodiment.

The instant invention may be sized and shaped other than as previously described and illustrated in FIGS. 1 through 10. The device of the instant invention may have fewer than five chambers and be round in cross section. One such device 40 may be seen in FIGS. 11 and 12. This device 40 may be cylindrical and have four chambers, indicated by the numbers I through IV in FIG. 11. There may be a gas inlet pipe 41 at the forward end 42 for connection to the exhaust pipe 43 of the internal combustion engine. The exhaust gases may enter the device 40 through the gas inlet pipe 41 and then into the central tube 44 of chamber I. Chamber I of this device 40 may be similar to chamber A of the aforementioned device 20.

There may be a series of axial tubes 45 surrounding the central tube 44. The axial tubes 45 may be open at their forward ends and closed at their rearward ends by a bottom plate 48. There may be a plurality of openings 46 symmetrically spaced along the length of the central pipe 41. Each of these openings 46 may communicate with the inner end of an equatorial tube 47. The equatorial tubes 47 may be closed at their outer ends and may intersect with and communicate with the axial tubes 45 to form a complex network of interconnected passageways. The gases may collide with the walls of the axial 45 and equatorial 47 tubes and with each other. The collisions and friction effects may result in an increase of energy and a great increase in temperature in chamber I. The spaces between the tubes and the walls of chamber I may be insulated to favor the heat buildup and contribute to the increased temperatures. The high temperatures in chamber I may cause the molecules of the exhaust gases to break down and undergo changes within this chamber in the same manner as previously described.

The resulting gas molecules may leave chamber I from the open forward ends of the axial tubes 45 and enter chamber II which may be larger in this embodiment than chamber B of the device 20. The molecules may spread out and move in swirling patterns and finally leave chamber II through rearwardly directed axial tubes 49 which may lead to a smaller chamber III located rearward of and adjacent to chamber I. The gases may leave chamber III through an exit pipe 50 and enter chamber IV which may be considerably larger then chamber III and which may have a wide open end from which the gases may be rapidly dispersed into the atmosphere.

The heating, expansion and cooling effects noted previously may also occur in this device 40 so that further discussion is not necessary. The wide open rearward end 51 of this device 40 may permit the gases to be expelled more quickly and may further lessen any possibility of back pressure.

Figure 13:
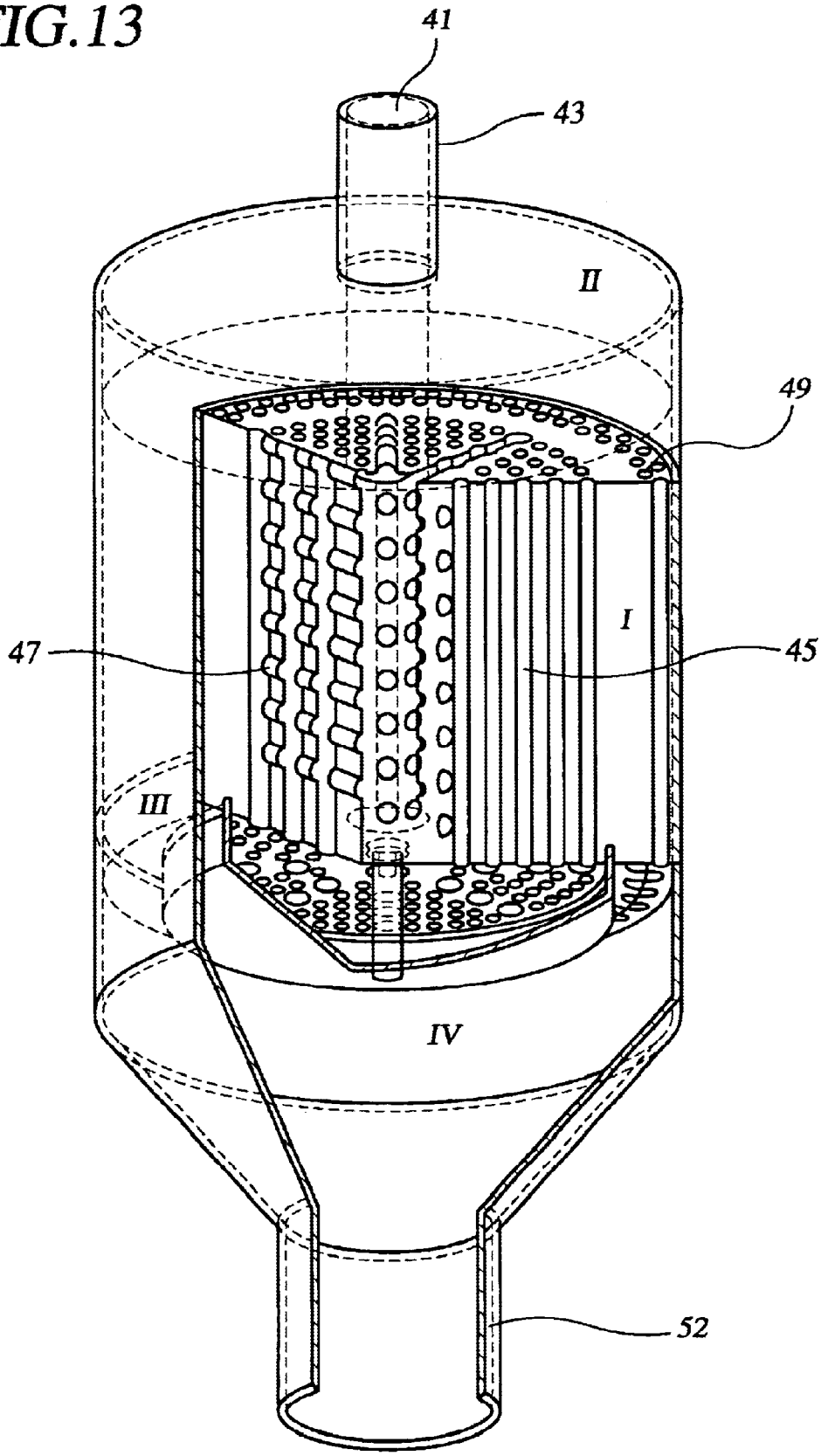
FIG. 13 is a perspective view of a modification of the second embodiment.

The four chambered device may also have a tapered rear end with an exit pipe 52 as seen in FIG. 13.

The device of the instant invention may be made of a ceramic material that can withstand the temperatures generated within the first chamber, or it may be made of stainless steel, also capable of withstanding such temperatures without corrosion or decomposition. When constructed of stainless steel there may be insulation between the axial and equatorial tubes of the first chamber and about the walls of the first chamber. When constructed of a ceramic material the thickness of the walls between the many passageways may provide their own insulation. It may be most important to have high temperatures in the first chamber to break down pollutants and enough expansion and lessening of kinetic energy in subsequent chambers to cool the gases so that they may safely be introduced into the environment. The device 20 may be only 18 inches (45.7 cm) long and 10 inches by 6 inches (25.4 cm by 15.2 cm) in cross section. There may be no need for a catalyst and there may not be any buildup of particles within the core, which may provide for a clean burning and long lasting muffler and gas purifier.

While two embodiments of the present invention have been illustrated and described in detail, it is to be understood that this invention is not limited thereto and may be otherwise practiced within the scope of the following claims.

I claim:

1. An anti-pollution and muffling device for the treatment of the exhaust gases produced by internal combustion engines and the like, said device comprising:

entry means to bring the exhaust gases from the internal combustion engine to the device;

insulated core for receiving the exhaust gases;

multiple interconnected passage means within said core for directing the gas flow in diverse paths, greatly increasing the surface area within the core, and increasing the opportunities for collisions of gas molecules with the walls of the passage means and with each other, said increase in collisions resulting in a progressive and substantial rise in the kinetic energy and thereby the temperature within said core causing alterations to the molecules which greatly diminishes pollutants contained therein and said diverse paths resulting in repeated alteration of the direction of the gas flow causing a muffling effect in the noise associated with such gas flow;

tube means to convey the gas flow containing the altered molecules out of the core;

at lease two chamber means, disposed at opposing ends of the core, and being integral therewith, the first of the at least two chamber means for receiving the gas flow from the core and the second of the at least two chamber means for receiving the gas flow from the first of the at least two chamber means, said chamber means for permitting the gas flow to expand and experience fewer collisions and form into swirling and convection patterns resulting in a successive decrease in the kinetic energy and the temperature as the gas flow moves from the first to the second of the at least two chamber means and such that the gas flow is caused to reverse direction as it progresses from the first to the second of the at least two chamber means resulting in a further muffling effect in the noise associated with the exhaust gas flow;

transport means to direct the gas flow from the core into the first of the at least two chamber means;

transport means to direct the gas flow from the first of the at least two chamber means into the second of the at least two chamber means; and conduit means for removing the cooled, noiseless exhaust gases containing the altered molecules from the device.

2. An anti-pollution and muffling device for the treatment of the exhaust gases produced by internal combustion engines and the like, said device comprising:

an elongated housing having a forward end and a rearward end;

a gas inlet pipe situated at the forward end of the housing to receive the exhaust gases;

a first chamber substantially centrally situated within the housing and forming the core of the device, said first chamber being substantially cylindrical and comprising:

an insulated outer wall, a bottom plate, an axial gas inlet tube in communication with the gas inlet pipe and extending to and being integral with the bottom plate, a plurality of axial tubes in laterally spaced parallel relation to each other and to said gas inlet tube, said axial tubes being open at their forward ends and being integral with the bottom plate at their rearward ends, a plurality of openings symmetrically disposed about and along the length of the gas inlet tube, a plurality of equatorial tubes having inner ends and outer ends and each of said tubes being in communication with one of the openings in the gas inlet tube at its inner end and being integral with the outer wall at its outer end and said equatorial tubes further being in communication with the axial tubes with which they intersect, said axial tubes and equatorial tubes forming a complex network of interconnected passageways within the first chamber into which the exhaust gases are directed;

insulation means disposed around the first chamber and between the inlet tube, the axial tubes and the equatorial tubes for maintaining heat generated within said first chamber;

a second chamber disposed forward of the first chamber and being in communication with the forward ends of the axial tubes through which the gases leave the first chamber and enter the second chamber;

a first series of lateral passages extending rearwardly from the second chamber through which the gases exit the second chamber;

a third chamber disposed rearward of the first chamber and in communication with the first series of lateral passages;

at least one additional chamber;

at least one second series of lateral passages extending from the third chamber to the at least one additional chamber for the passage of the gases therethrough; and a gas outlet pipe in communication with the at least one additional chamber from which the gases exit the device;

whereby the exhaust gases enter the device and pass into the first chamber where they undergo multiple collisions with the walls of the axial and equatorial tubes and each other such that the kinetic energy and thereby the temperature is progressively and substantially increased causing alterations to the gas molecules which alterations diminish the pollutants contained therein, and repeatedly reversing direction through the interconnected passageways thereby attenuating the noise associated with such exhaust gases, and thereafter the exhaust gases proceed from the first chamber to the next, each time reversing direction and thereby interfering with the sound wave progression and altering the sound wave patterns to further attenuate the noise, and such that the gas molecules spread out into the successive chambers where they are formed into swirling and convection patterns with a decrease in the number of collisions thereby decreasing the kinetic energy and the temperature such that when the exhaust gases exit the device into the atmosphere there are no harmful molecules and the exhaust gases are cooled sufficiently so as not to present a problem to the environment.

3. A device as in claim 1 wherein at least a portion of the equatorial tubes diverge from the gas inlet tube to the outer wall, said divergence creating an interference in sound wave progression to muffle the noise associated with the exhaust gases.

4. A device as in claim 1 wherein the sum of the cross sectional areas of the openings in the gas inlet tube is at least equal to the cross sectional area of the gas inlet tube thereby preventing any back pressure to the engine.

5. A device as in claim 1 wherein the gas inlet pipe containing the exhaust gases extends through the second chamber into which the heated gases have been expelled from the first chamber, said heated gases serving to warm the incoming exhaust gases.

6. A device as in claim 1 wherein the third chamber is larger than the second chamber.

7. A device as in claim 1 wherein the at least one additional chamber is larger than the third chamber.

8. A device as in claim 1 wherein the gas outlet pipe is substantially as wide as the at least one additional chamber to permit rapid expulsion of the exhaust gases from the device.

9. A method for muffling the noise associated with exhaust gases from internal combustion engines and the like and for purifying the exhaust gases, said method comprising:

obtaining an insulated chamber containing multiple interconnected passages facing in diverse directions;

directing the exhaust gases into said chamber;

causing the molecules of the exhaust gases to repeatedly collide with the walls of the passages, the ends of the passages, and with other molecules;

accelerating the exhaust gases;

substantially increasing the kinetic energy of the molecules and thereby the temperature of the exhaust gases causing an alteration of the molecules;

causing the exhaust gases to repeatedly change their direction of flow;

diminishing the noise associated with the exhaust gases;

providing a second chamber, adjacent to said first chamber and open within;

directing the exhaust gases with the altered gas molecules into the second chamber;

decelerating the exhaust gases;

decreasing the kinetic energy of the molecules and thereby cooling the exhaust gases;

further diminishing the noise;

providing a third chamber, open within, adjacent to said first chamber, and being disposed in an opposing direction from the second chamber;

directing the exhaust gases into the third chamber;

further decelerating the exhaust gases;

expanding the exhaust gases;

cooling the exhaust gases;

further diminishing the noise associated with the exhaust gases;

providing at least one additional chamber, open within and disposed in an opposing direction from the third chamber;

decelerating the exhaust gases;

expanding the exhaust gases;

cooling the exhaust gases;

further diminishing the noise; and directing the cooled, altered and noiseless exhaust gases into the atmosphere whereby the repeated change in direction of the exhaust gases causes interference in the sound wave patterns and muffles the noise while the substantial increase in temperature in the first chamber alters the molecules to purify the exhaust gases and the subsequent expansion of the exhaust gases, the decrease in the number of collisions and the change in flow patterns as the exhaust gases pass through the second, third and at least one additional chamber results in a cooling of the exhaust gases before they enter the atmosphere.

* * * * *